US008113218B2

(12) United States Patent
Nguyen

(10) Patent No.: US 8,113,218 B2
(45) Date of Patent: Feb. 14, 2012

(54) INTERLOCKED V-SHAPED POINTED EYELASHES

(76) Inventor: Quyen T Nguyen, Beltsville, MD (US)

( * ) Notice: Subject to any disclaimer, the term of this patent is extended or adjusted under 35 U.S.C. 154(b) by 285 days.

(21) Appl. No.: 12/318,771

(22) Filed: Jan. 8, 2009

(65) Prior Publication Data

US 2010/0170526 A1 Jul. 8, 2010

(51) Int. Cl.

| | |
|---|---|
| ***A41G 3/00*** | (2006.01) |
| ***A41G 5/00*** | (2006.01) |
| ***A41G 5/02*** | (2006.01) |
| ***A45D 40/30*** | (2006.01) |

(52) U.S. Cl. ..... 132/201; 132/216

(58) Field of Classification Search ..... 132/200, 132/201, 203, 206, 210, 211, 212, 216, 105, 132/53–56, 320, 217, 317, 319; D28/92, D28/93, 99, 10; 623/15.11

See application file for complete search history.

(56) References Cited

U.S. PATENT DOCUMENTS

| | | | | |
|---|---|---|---|---|
| 1,897,719 | A * | 2/1933 | Birk | 132/217 |
| 3,833,007 | A | 9/1974 | Jacobs | |
| 3,880,175 | A | 4/1975 | Hosokawa | |
| 3,900,038 | A | 8/1975 | Masters | |
| 4,299,242 | A | 11/1981 | Choe | |
| 5,547,529 | A | 8/1996 | Woolf | |
| 6,536,445 | B2 * | 3/2003 | Kuroda | 132/217 |
| D510,159 | S * | 9/2005 | Song | D28/92 |
| D632,018 | S * | 2/2011 | Nguyen | D28/92 |
| D632,019 | S * | 2/2011 | Nguyen | D28/92 |
| 2005/0061341 | A1 | 3/2005 | Choe | |
| 2007/0023062 | A1 | 2/2007 | McKinstry et al. | |
| 2007/0272264 | A1 | 11/2007 | Byrne | |
| 2007/0295353 | A1 | 12/2007 | Dinh | |
| 2008/0196732 | A1 * | 8/2008 | Merszei | 132/201 |
| 2009/0217938 | A1 * | 9/2009 | Rabe et al. | 132/216 |

* cited by examiner

*Primary Examiner* — Todd Manahan
*Assistant Examiner* — Vanitha Elgart
(74) *Attorney, Agent, or Firm* — Thien Tran, Esq.; Access Patent Group, LLC.

(57) ABSTRACT

A method to apply a V-shaped eyelash having four symmetric tapered strands attached at the mounting portion to natural eyelash's hair. The V-shaped eyelash has two strands on each side. The V flare corresponds to an angle can be less than or equal to 160° degrees. The thickness of each strand can be 0.10 mm to 0.30 mm thick at the base and tapered at the tips. The lengths can be from 7 mm to 17 mm giving the illusion of a natural long, beautiful and luscious eyelash. Because the eyelash extension is a V shape with the two strands on each side, the eyelash can distribute weight evenly on each side. The natural hair strand as the holder at center also making the eyelash extensions last longer. The eyelashes are made from synthetic fiber which is crimp free and can be permed to a C, and J curl.

9 Claims, 4 Drawing Sheets

INTERLOCKED V-SHAPED POINTED EYELASHES

CROSS REFERENCE TO RELATED APPLICATION

Not Applicable

STATEMENT OF FEDERALLY SPONSORED RESEARCH/DEVELOPMENT

Not Applicable

BACKGROUND OF THE INVENTION

False eyelashes have been in use for over 30 years. They are typically inserted alongside real eyelashes, by first applying a little glue to a cluster. Once the false eyelashes are in place, mascara is used to blend the real and false eyelashes together. The cosmetic use of artificial eyelashes by persons is old in the art. Typically, eyelash sets comprise left and right arrays of lash hairs held together on an adhesive strip, and the array is attached to the skin of the upper eyelid of the wearer to cosmetically extend the length of the wearer's natural eyelashes. The individual hairs of the array are aligned with their bases in a substantially common direction. The bases of the lash hairs are embedded in the support strip, preferably in its leading edge. It is known in the art how to produce, select, sculpt and arrange the individual hairs of the array to provide various aesthetically desirable configurations of the array in combination with the support strip. As noted above, prior art artificial eye lashes typically are applied to the skin of the wearer. It would be beneficial to have an alternative that does not attach to or contact the skin of the wearer. A benefit of this is a reduced risk that the wearer would be exposed to the solvents or other chemicals in the adhesive and mounting strip of the eyelash strip. Therefore, there is a continuing need for eyelash extensions that can stay affixed more permanently by interlocking adhesive attachment sections.

DESCRIPTION OF RELATED ART

A discussion of the related art of which the present inventor is aware, and its differences and distinctions from the present invention, is provided below. The following references provide a general teaching in the area of applying eyelash extensions, but they fail to provide the limitations of the present invention's system and method.

US20050061341, issued to Choe, Yeong-Jin, entitled "False eyelashes", describes false eyelashes. The false eyelashes for attachment to the edge of an eyelid, comprises lashes arranged in a curved state, and an attachment section formed by applying an adhesive to one end of the lashes. The attachment section is formed such that the lashes are not knotted together at the attachment section, where the false eyelashes are applied to the edge of an eyelid of each eye. The lashes are grouped together in a plurality of segments. Note: Japanese Patent JP2005146500 is similar.

U.S. Pat. No. 4,299,242, issued to Choe, Sunjeen, entitled "Method of making artificial eyelashes", describes a system for making artificial lashes. Single strands of hair or multiple strands are knotted on a support. Heat is applied below the knot so that the lashes fuse together, and adhesive bonding applied in the same area. Next, scissors are used to separate the group of lashes from the knot. Finally, the lashes are trimmed and curled to the desired length and style, and their free ends spread at a position to create flared lashes.

U.S. Pat. No. 5,547,529, issued to Woolf, David, entitled "Process for fabricating false eyelash stem", describes a system for fabricating false eyelashes. Long fibers are kinked at their center to form a loop. The loop is tightened to form a preliminary knot around a main string. The fibers are then cut a distance away from the knot to form a cluster. Heat is then applied to curl the clusters. Cement is applied near the preliminary knot and then the knot is finally removed creating a knot-free cluster of curled false eyelashes.

U.S. Pat. No. 3,833,007, issued to Jacobs, Peggy, entitled "Artificial eyelashes", describes artificial eyelashes. A single feathered lash consists of several individual lashes secured together at a group fold and generally includes 3 to 8 lashes. An adhesive process is applied to the lash group folds so they may become permanently affixed to each other. The lashes may be composed of synthetic hair and may be subject to permanent or semi-permanent curling JP2005113302, issued to Yuko Sannomiya, entitled "False eyelashes", describes false eyelashes.

The false eyelashes comprise hollow tubular eyelash main bodies having opened eyelash insertion holes at the base end parts. The base parts of the eyelash main bodies may be integrally equipped with the base parts of other false eyelashes.

US20070295353, issued to Dinh, Daniel Phu, entitled "Eyelash extensions and method for applying eyelash extensions", describes a single distal portion can be branched to further include a plurality of branches. In this aspect, each branch has a distal end such that the filament with the proximal end and plurality of branches forms a branched eyelash extension. The branches provide a user with an appearance of having thick and full eyelashes (appearing to have more eyelashes than they actually do). A branch angle exists between each of the branches. The branch angle is to any degree that provides a pleasantly aesthetic look to the user yet still remains comfortable to wear. As a non-limiting example, the branch angle is less than or equal to 180 degrees. Further, the branch angle can be the same or vary between adjacent branches on the eyelash extension.

US20070272264, issued to Byrne, Alexsandra, entitled "Eyelash adornment", describes lash subassembly has lash filaments that are gathered at the base portion in alternating smaller (two to six lash filaments) and larger (ten to twenty lash filaments) clusters that diverge and overlap each other forming an X-shaped pattern.

US20070023062, issued to McKinstry et al., entitled "3D-lashes perfect bonding system", describes a method for preparing a customer with 3-D lashes. A contoured lower eyelid tape member that has two surfaces with one surface capable of sticking onto human skin surface is provided. Contoured lower eyelid tape member is cut such that it is disposed to cover completely the lower natural eye lashes of the customer so than no entanglement of the lower natural lashes with the upper lashes of the customer may occur.

U.S. Pat. No. 3,900,038, issued to Masters, George, entitled "Method of preparing and placing artificial eyelashes", describes that the lash sections are placed on the eyelid above the natural eyelash line with conventional adhesive, the sections may be placed using a pair of tweezers or like instrument, or by transferring each section from the fingertip to the eyelid. The sections are applied beginning at the inside of the eye and working outward, preferably applying the first section beginning about ¼ inch-⅜ inch from the tear duct.

FIELD OF THE INVENTION

The invention pertains to the field of artificial eyelashes or eyelash extensions. Artificial or false eyelashes are normally for attachment to the edge of an eyelid. The false eyelashes include a plurality of lashes arranged in a V shape; and an attachment section formed by applying an adhesive to one end of the lashes, the attachment section being formed such that the lashes are not knotted together at the attachment section. A plurality of the false eyelashes is applied to the edge of an eyelid of each eye.

BRIEF SUMMARY OF THE INVENTION

The present invention relates to a V-shape eyelash interlocking artificial eyelash unit that attaches to a subject wearer's existing natural eyelashes to modify their appearance. The unit is preferably applied as a left and right set of units, with the left and the right sets including an upper unit and optionally including a lower unit. The left and right sets correspond to the wearer's left and right eyes. The upper and lower units of a set correspond to the upper and lower surfaces of a wearer's natural eyelashes. Each unit includes an array of four symmetric tapered artificial synthetic lash strand. Each symmetric tapered artificial synthetic lash strand having a mounting portion and a shaped pointed or tapered tip. Preferably, the artificial lash strands are sculpted, in that the mounting portion of the individual lash strand is thicker than its tip. The symmetric tapered artificial synthetic lash strands are somewhat spaced apart in the array with their mounting portion in a common direction relative to a lash line.

BRIEF DESCRIPTION OF DRAWINGS

In order to more fully understand the manner in which the above recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
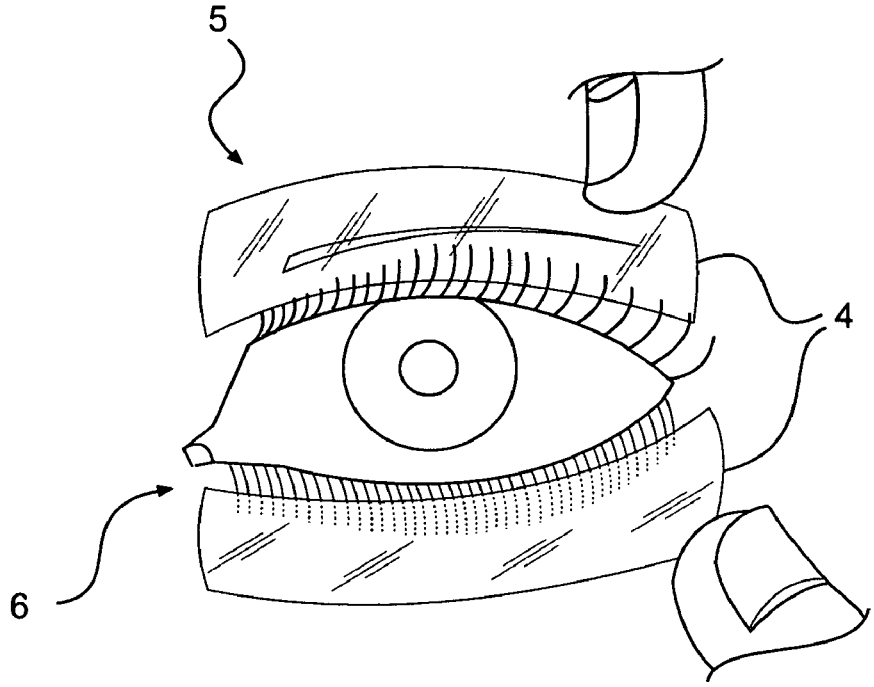
FIG. 1 is a schematic front view of eyelid with natural eyelashes.
Figure 2:
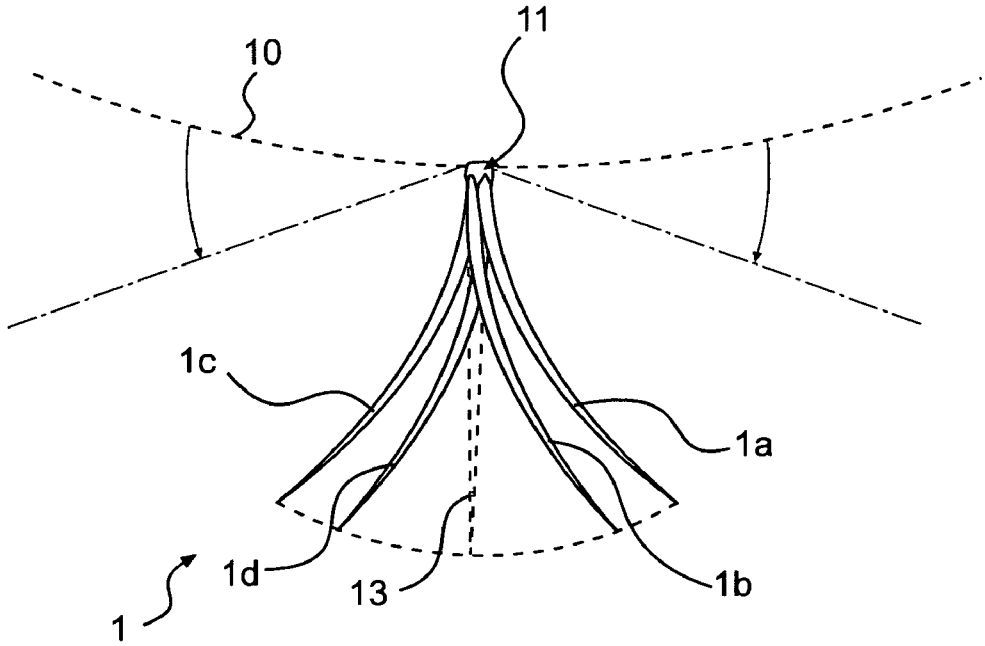
FIG. 2 is a schematic top view of the interlocking V-shape lash strand with natural eyelash hair shown as dotted lines.

The present invention is directed to a method for applying eyelash extensions 1. Referring to FIGS. 1-2, individual lashes 1 having four symmetric tapered strands (1*a*, 1*b*, 1*c*, 1*d*) attached at a mounting portion 11 in a V-shape. The eyelash made up of 4 strands (1*a*, 1*b*, 1*c*, 1*d*), 2 on each side, which forms the "V" shape. Each two strands (1*a*-1*b*) and (1*c*-1*d*) are on each side. The flare-out V-shape is corresponding to an angle can be less than or equal to 160° degrees. The thickness of each strand (1*a*-1*b*) can be 0.10 mm to 0.30 mm thick at the base (or mounting portion 11) and tapered at the tips. The lengths can be from 7 mm (shortest) to 17 mm (longest) giving the illusion of a natural lash. Because the lash extension 1 is a V-shape with the two strands (1*a*-1*b*) or (1*c*-1*d*) on each side let the eyelashes distribute weight evenly on each side and the natural hair strand 13 as the holder also making the lash extensions 1 last longer. The eyelash extensions 1 are made from synthetic fiber which is crimp free and can be permed to a C or J curl. The V-shape eyelash 1 is a synthetic eyelash extension with a silk-like feel. The lashes 1 look very natural because of the tapered ends of the eyelash strands (1*a*, 1*b*, 1*c*, 1*d*). The V-shape lashes 1 comes in two standard colors: black and brown. The lashes 1 are light weight and soft. The V-shape eyelashes 1 feels and looks natural. The "V" shape design allows the interlocking of the lashes 1 for quick application and durability. The lashes 1 are water-resistant and also singe-resistant, which means the lash 1 maintains its shape despite the effects of water or light heat. Fully customizable, the lashes 1 can be adjusted to client's comfort and eye shape. More lashes 1 are added for a fuller look or apply fewer lashes 1 for a more natural look.

Method for Applying Eyelash Extensions

Described below is a method for applying eyelash extensions 1. The eyelash extensions 1 of the present invention can be applied to a user using a variety of methods. As can be appreciated by one skilled in the art, the method described herein is for illustrative purposes only and the invention is not intended to be limited thereto.

The whole process has five steps as follows:

1. Identify the different eye conditions that affect the eyelash application (e.g. stye, conjunctivitis (or pink eye), dry eyes, allergic conjunctivitis, bacterial conjunctivitis, itching, tearing, swollen eyelids, swelling of the conjunctiva . . . etc. . . . ).
2. Properly follow preparation and sanitation procedures prior to eyelash application (e.g. soaking all tools in alcohol; use new toothpick, Q-tip, and tape for each eyelash client . . . etc. . . . ).
3. Make an assessment on what style best suits for client (e.g. recommend a style, length, extra glue . . . etc. . . . ).
4. Apply the V-shape synthetic lashes 1 using the interlocking technique.
5. Safely remove the eyelash extensions (by remover 9, . . . ).

Note: The term "eyelash extensions" are equivalent to artificial or false eyelashes.

The method for applying eyelash extensions 1 includes a plurality of acts to attach multiple interlocking layers of eyelash extensions 1 to the user's natural eyelashes 13. Before the eyelash extensions 1 are applied, the user's natural eyelashes 13 are cleaned using water or a cleaning solution. The natural eyelashes 13 are then air-dried or dried using a fan or other drying mechanism.

Figure 6:
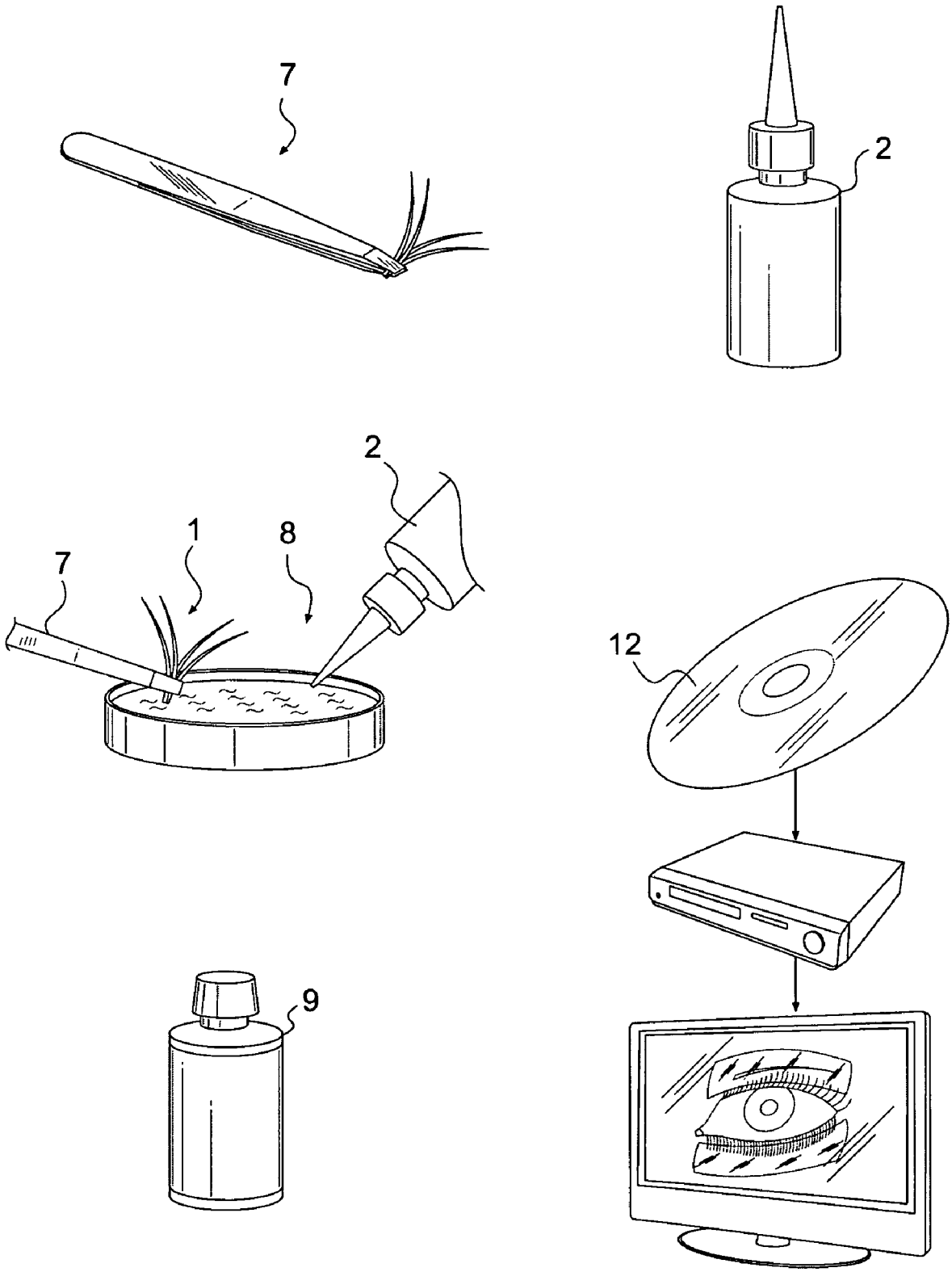
FIG. 6 is a view of DVD instructional display player for displaying eyelashes' process to the client or students.

As shown in FIGS. 1 and 6, individual eyelash extensions 1 are applied to a user's eyelashes using an adhesive 2 e.g. a glue. The eyelash extensions 1 can be applied only to the user's upper eyelashes 5 but not on lower eyelashes 6. As can be appreciated by one skilled in the art, although the eyelash extensions 1 are applied individually, if desired, they can be applied as a group to a single eyelash. Or alternatively, a single eyelash extension 1 can be applied to multiple eyelashes. However, in most cases it is desirable to have a single eyelash extension 1 attached to a single natural eyelash 13.

As shown in FIG. 1, the natural eyelashes 13 before the application of the eyelash extensions 1 are kept in a protected and stationary position with the use of medical surgical tape 4. The tape 4 adheres lightly to the delicate skin of the eye area and is used to protect the lower eyelid's lashes 6 from the upper eyelids lashes while the latter are being worked on.

Figure 5:
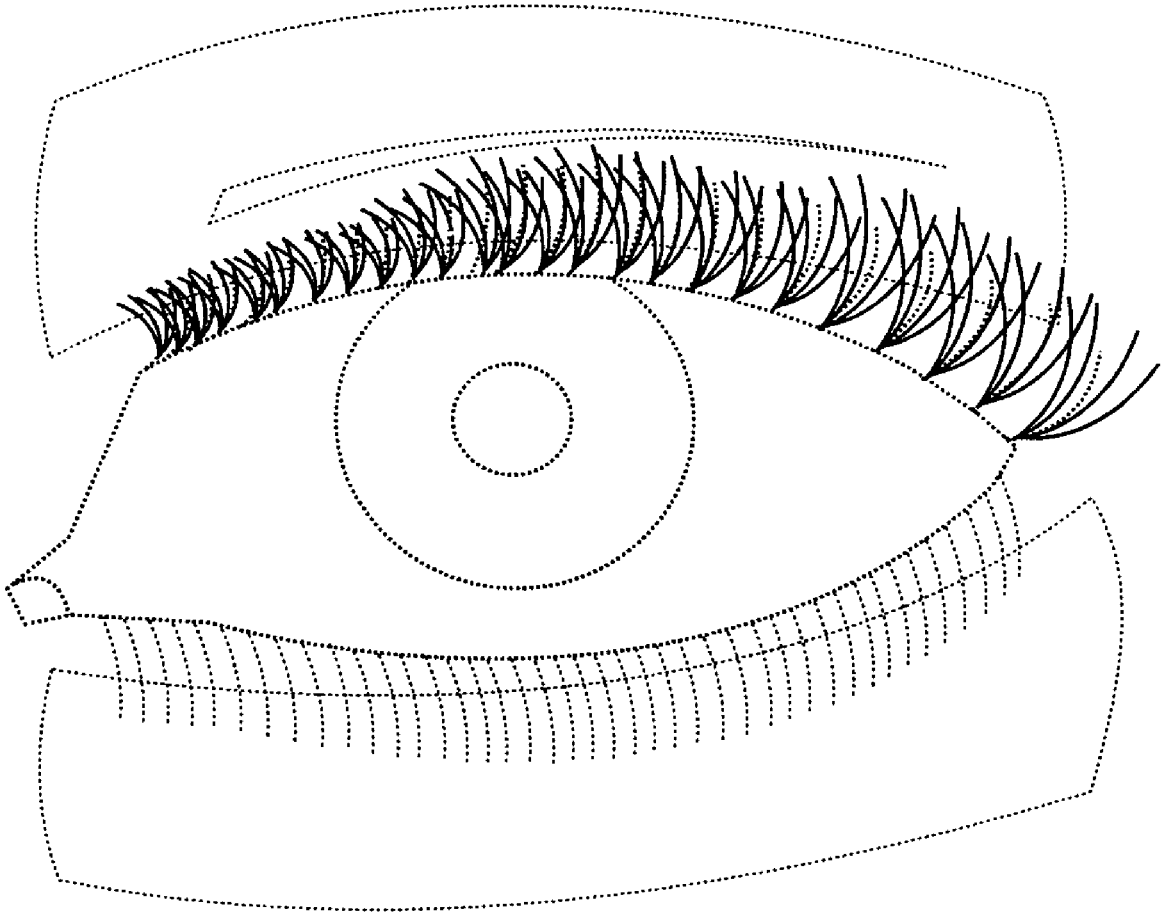
FIG. 5 is a schematic front view of the completed application.

After taping the lower lashes 6 and taping the upper eyelids 5, the tweezers 7 are used to remove the false eyelash 1 from a container and gripping extension 1 from mounting portion or the base 11. With the tweezers 7 gripping the first eyelash 1, we dip the mounting portion 11 of the eyelash 1 into the bonder or glue dipping tray 8. Firstly, we start with the right eye of client and then apply the first glued eyelash 1 to a base of the natural lash line 10 1 mm-2 mm away from the eyelid's skin. Then, we take a second V-shape eyelash 1 and dip the mounting portion 11 and the left side strands of the extension 1 into the bonder 8 and place onto the first right strand of the previous attached eyelash (1*c*-1*d*) to interlock or criss-cross eyelash extension tips (1*a*-1*b*) of the second or different V-shape eyelash 1. When at the center or midway of the eyelid, it maybe desired to choose a V-shape eyelash 1 having a longer length which is applied in the same manner. Then, we choose an appropriate length for the inner's eyelid, a shorter length (for example: 7 mm, 8 mm, 9 mm and 10 mm) and choose a longer length for the center or middle area of the eyelid (for example: 10 mm, 11 mm, 12 mm, 13 mm). Then, we choose the longer length for the outer area of eyelid (for example: 14 mm, 15 mm, 16 mm, and 17 mm) as shown in FIG. 5.

In the preferred embodiment, one side of the V-shape eyelash flare does not have any adhesive 2 and relies on the strands previously attached to retain the assembly together. e.g. interlocking or criss-cross.

Yet in another preferred embodiment, each unit of the eyelash extensions 1 includes a plurality of strands (1*a*, 1*b*, 1*c*, 1*d*). Each strand (1*a*, 1*b*, 1*c*, 1*d*) is formed in a shape similar to that of natural eyelashes. That is, each of the eyelashes's strand (1*a*, 1*b*, 1*c*, 1*d*) is formed with one end thereof hereinafter referred to as a free end flared outwardly. A plurality of the eyelashes (1*a*, 1*b*, 1*c*, 1*d*) are arranged such that opposite ends hereinafter referred to as intersections are merged to form an interlocking attachment section 3 with glue. The attachment section 3 is located far away (about 0.5 to 0.85 of total length of each strand) from the mounting base 11.

Figure 3:
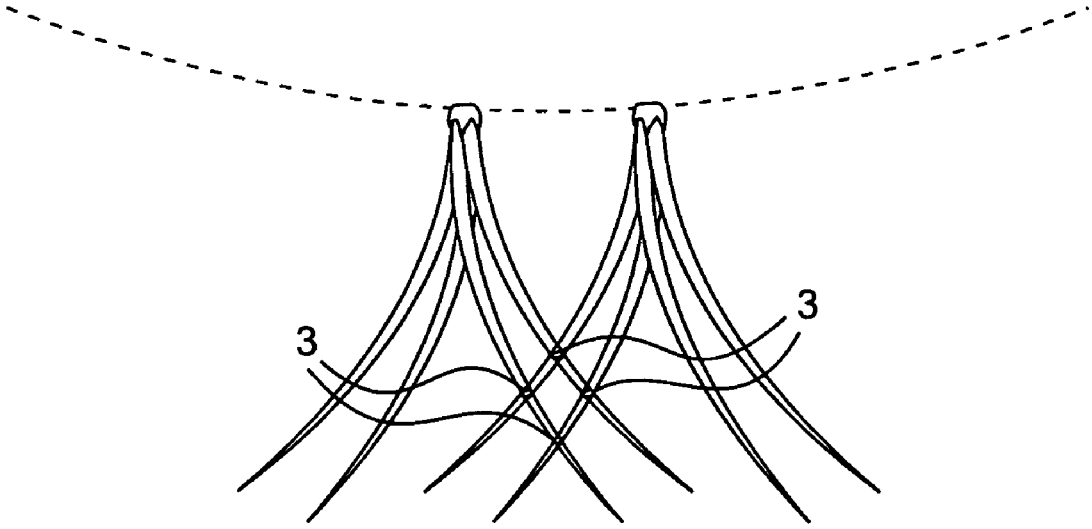
FIG. 3 is a schematic top view of the interlocking process and glue areas.
Figure 4:
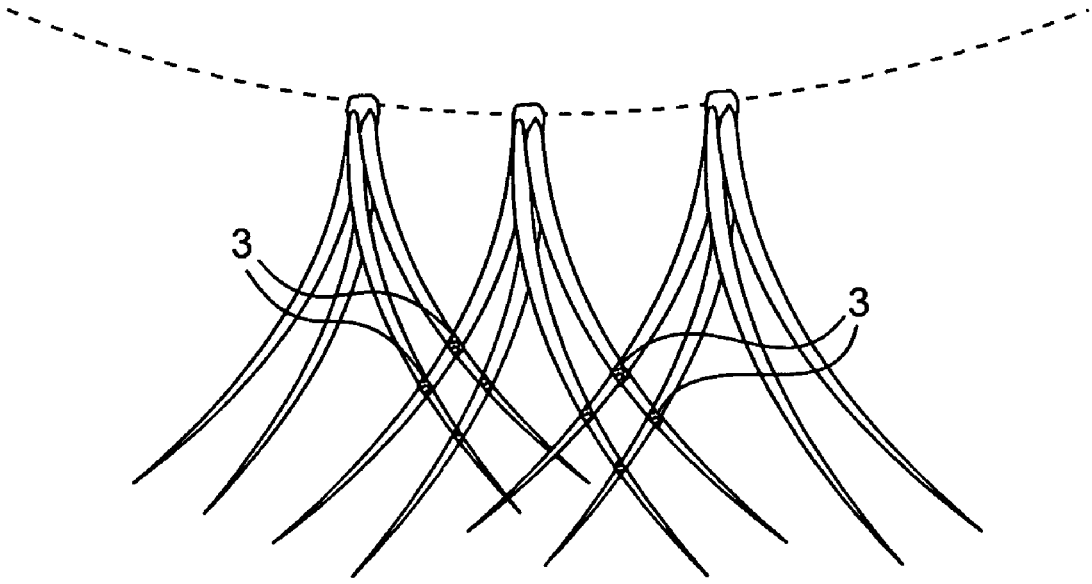
FIG. 4 is a schematic top view with additional strands applied.

As shown in FIGS. 3-4: The interlocking attachment section 3 of each strand (1*a*, 1*b*, 1*c*, 1*d*) is applied with an adhesive for attachment of corresponding eyelash units. The mounting portion 11 of the eyelashes 1 are formed substantially along a straight line, and not in a knotted configuration (e.g. knot-free or knotfree), and are attached to the natural eyelash 13 using adhesive or glue. Such a flared strand (1*a*, 1*b*, 1*c*, 1*d*) would provide an appearance of long, beautiful, luscious eyelashes.

As shown in FIG. 5: for the inner area of eyelid (close to the nose), a shorter length (for example: 7 mm (shortest), 8 mm, 9 mm and 10 mm) of eyelash are used. Then, we choose a longer length for the center or middle area of the eyelid (for example: 10 mm, 11 mm, 12 mm, and 13 mm). Then, choose the longer length for the outer area of eyelid (for example: 14 mm, 15 mm, 16 mm, and 17 mm (longest)).

Now, we do the same for the left eye. We start with the inner eye first. With the tweezers 7, we grip the V-shape symmetric tapered eyelashes 1 and dip the base 11 of the eyelash 1 into the bonder 8. Then, we apply the eyelash 1 to the base 11 of the natural lash 1 mm to 2 mm away from the skin. Then, we take the second V-shape eyelash 1, dip the base 11 of the right strand into the bonder 8. We attach the first two right strands (1*c*-1*d*) of eyelash 1 onto the two second left strand (1*a*-1*b*) of the second or different eyelash 1 to interlock or criss-cross at interlocking attachment section 3. Then, we continue for the next eyelash. In the midway, we choose a length of eyelash that is a little bit longer. We follow the same procedures as the previous steps. We dip the base 11 and overlap the right strands (1*c*-1*d*) with the left side strands (1*a*-1*b*) of another or different V-shape eyelash 1. Towards the ends, we chose a longer length and follow the same interlocking procedures.

Finally, the eyelashes 1 are then being dried. Once the eyelash 1 is dry then the eyelashes 1 are interlocked so that the eyelashes 1 will stay in place and last longer. After the eyelashes 1 are dried, we remove the tape 4 used during the process. We then check to make sure that the eyelashes 1 are not stuck to the bottom lashes or to the tape 4. Moreover, we make sure the client keeps their eyes closed for ten minutes or longer. After that, the eyelashes 1 are curled with a heated curler if needed. After finishing the application of the eyelashes 1, we lift the eye up slightly to see if there is any hair stuck to the top or if the top lash is poking into their eyes.

As shown in FIG. 6: an instructional video (DVD) 12 with a training program includes one or more of the following items: live workshops, video conferencing, a multimedia training course, trade show, training kit, brochures for safe application of the V-shape interlocking artificial eyelash units to a client or wearer.

ITEMS'S LIST eyelash extensions 1 with flared out symmetric tapered V-shape synthetic eyelash strands 1*a*-1*d* adhesive medical glue 2
medical surgical tape (or eyepad) 4
upper eyelid 5
lower eyelid 6
bended or straight pointed tweezers 7
bonder or glue dipping tray 8
adhesive remover 9
instructional DVD 12

It is to be understood that the present invention is not limited to the embodiments described above, it is evident that many alternatives, modifications and variations will be apparent to those skilled in the art. Accordingly, the exemplary embodiments of the invention as set forth above are intended to be illustrative and not limiting. Various changes may be made without departing from the spirit and scope of the invention as defined in the following claims.

I claim:

1. A method for applying artificial eyelashes to the natural eyelashes of a customer, comprising steps of:

providing a V-shape artificial eyelash; wherein the artificial eyelash has four symmetric tapered strands joined together at a knot-free mounting portion;

pulling each two of the strands of eyelash into a V-shape and flared out configuration;

dipping the artificial eyelash with the knot-free mounting portion to a glue bonder; then applying the glued mounting portion of the artificial eyelash directly to an inner one naturally growing eyelash of the right eye of said customer first; and centering the naturally growing eyelash at the center with said two of the tapered strands of artificial eyelash on the left and with said two of the tapered strands of artificial eyelash on the right of said naturally growing eyelash.

2. A method for applying artificial eyelashes to the natural lashes as set forth in claim 1, further comprising steps: making artificial eyelashes from synthetic fiber which is crimp free and perming the eyelashes to a C curl.

3. A method for applying artificial eyelashes to the natural lashes as set forth in claim 1, further comprising steps: making artificial eyelashes from synthetic fiber which is crimp free and perming the eyelashes to a J curl.

4. A method for applying artificial eyelashes to the natural lashes as set forth in claim 1, further comprising steps: pulling each two of the strands into a V-shape with an angle that can be less than or equal to 160 degrees.

5. A method for applying artificial eyelashes to the natural lashes as set forth in claim 1, further comprising step: interlocking two symmetric tapered strands of artificial eyelash to corresponding two strands of the previously adjacent V-shape artificial eyelash at new glued attachment sections thereon.

6. A method for applying artificial eyelashes to the natural lashes as set forth in claim 1, further comprising step: making the thickness of the flared strands between approximately 0.10 mm and 0.30 mm.

7. A method for applying artificial eyelashes to the natural lashes as set forth in claim 5, further comprising steps: applying glue to the attachment sections of the next V-shape artificial eyelash and putting the next V-shape artificial eyelash into a repeating interlocking pattern connecting the artificial eyelashes' strands together.

8. A method for applying artificial eyelashes to the natural lashes as set forth in claim 1, further comprising steps: making the lengths of the strands from 7 mm to 17 mm.

9. A method for applying artificial eyelashes to the natural lashes as set forth in claim 1, further comprising steps: storing all of the steps in a storage media for training purpose.

* * * * *